US012180958B2

(12) United States Patent
Raatschen et al.

(10) Patent No.: US 12,180,958 B2
(45) Date of Patent: Dec. 31, 2024

(54) FLOW CHANNELING STRUCTURE

(71) Applicant: Schwäbische Hüttenwerke Automotive GmbH, Aalen (DE)

(72) Inventors: Moritz Raatschen, Bad Schussenried (DE); Thomas Finsterle, Ravensburg (DE); Fabian Eisele, Herbertingen (DE); Gerd Jäggle, Ettingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/957,430

(22) Filed: Sep. 30, 2022

(65) Prior Publication Data

US 2023/0108147 A1 Apr. 6, 2023

(30) Foreign Application Priority Data

Oct. 4, 2021 (DE) ..... 10 2021 125 708.5

(51) Int. Cl.
*F04C 15/06* (2006.01)
*F04C 2/34* (2006.01)
*F04C 2/344* (2006.01)

(52) U.S. Cl.
CPC ..... *F04C 15/06* (2013.01); *F04C 2/34* (2013.01); *F04C 2/344* (2013.01); (Continued)

(58) Field of Classification Search
CPC ..... F04C 15/06; F04C 2/34; F04C 2240/20; F04C 2240/30; F04C 2250/10; F04C 2250/101; F04C 2250/102
See application file for complete search history.

(56) References Cited

U.S. PATENT DOCUMENTS 2,696,787 A * 12/1954 Jaworowski ..... F04C 14/04 418/269
10,753,358 B2 * 8/2020 Saito ..... F16H 57/12
(Continued)

FOREIGN PATENT DOCUMENTS

DE 10254220 A1 6/2003
DE 10233582 A1 2/2004
(Continued)

OTHER PUBLICATIONS

Machine translation and Foreign Patent Publication for CN-106151024-A, Inventor: Satoshi et al., Title: Variable Capacity of Vane Pump. (Year: 2016).*

(Continued)

*Primary Examiner* — Mary A Davis
(74) *Attorney, Agent, or Firm* — Buchanan Ingersoll & Rooney PC

(57) ABSTRACT

A rotary pump for delivering fluid includes: a pump housing having a low-pressure inlet and a high-pressure outlet for the fluid to be delivered; and a delivery rotor rotatable about a rotational axis in the pump housing and including a rotor base body and multiple deliverers distributed over the circumference of the rotor base body for delivering fluid from the low-pressure inlet to the high-pressure outlet. When the delivery rotor rotates, the radial and axial outer edges of the deliverers define a delivery region of the pump. The pump includes a flow channeling structure protruding axially into the low-pressure inlet in relation to the rotational axis of the delivery rotor from the pump housing wall in order to influence fluid flowing in the low-pressure inlet. The flow channeling structure arranged axially next to the delivery region and overlaps at least in portions with the delivery region in the radial direction.

17 Claims, 6 Drawing Sheets

(52) U.S. Cl.
CPC ..... *F04C 2240/20* (2013.01); *F04C 2240/30* (2013.01); *F04C 2250/10* (2013.01); *F04C 2250/101* (2013.01)

(56) References Cited

U.S. PATENT DOCUMENTS

| | | | |
|---|---|---|---|
| 2008/0181796 | A1 | 7/2008 | Schulz-Andres et al. |
| 2013/0094948 | A1 | 4/2013 | Ruatto et al. |

FOREIGN PATENT DOCUMENTS

| | | | |
|---|---|---|---|
| DE | 102005027607 | A1 | 1/2006 |
| DE | 102011084405 | A1 | 4/2013 |

OTHER PUBLICATIONS

German Search Report issued in German Patent Application No. 10 2021 125 708.5 mailed Jun. 22, 2022, 7 pages, with partial English translation.

* cited by examiner

FLOW CHANNELING STRUCTURE

CROSS REFERENCE TO RELATED APPLICATIONS

This application claims benefit of priority to German Patent Application No. 10 2021 125 708.5, filed Oct. 4, 2021. The contents of this application are incorporated herein by reference.

FIELD OF THE INVENTION

The invention relates to a rotary pump for delivering a fluid. The rotary pump can for example be a vane pump or a gear pump, in particular an internal gear pump. The rotary pump comprises a pump housing having a low-pressure inlet and a high-pressure outlet. A delivery rotor which can be rotated about a rotational axis is arranged within the pump housing. The delivery rotor comprises multiple delivery means which are distributed over the circumference of the delivery rotor and designed to deliver the fluid to be delivered from the low-pressure inlet to the high-pressure outlet while the rotary pump is in operation. The axial and radial outer dimensions of the delivery means define a delivery region of the rotary pump while the delivery rotor is rotating. The rotary pump also comprises a flow channeling structure arranged in the low-pressure inlet. The flow channeling structure is designed to influence, in particular redirect, the fluid flowing in the low-pressure inlet.

BACKGROUND OF THE INVENTION

In the prior art, rotary pumps are known in which the fluid to be delivered is axially and/or radially supplied to the delivery region from the low-pressure inlet, wherein the fluid to be delivered flows axially and/or radially into a low-pressure region of the delivery region from the low-pressure inlet. In the rotational direction of the delivery rotor, filling with the fluid to be delivered is regularly only possible to a limited extent, in particular at the beginning and towards the end of the low-pressure region. This is due to the fact that the fluid flowing in the low-pressure inlet exhibits only a main flow direction, namely a flow direction which is structurally predetermined by the shape of the low-pressure inlet. The fluid to be delivered therefore regularly flows onto the low-pressure region optimally in a sub-region only. This undesired effect means that the delivery characteristics of known rotary pumps are negatively influenced.

SUMMARY OF THE INVENTION

An aspect of the invention is a rotary pump which exhibits improved delivery characteristics and can simultaneously be manufactured cost-effectively.

The rotary pump in accordance with an aspect of the invention is designed to deliver a fluid. The rotary pump can for example be a vane pump or a gear pump, in particular an internal gear pump. The rotary pump comprises a pump housing having a low-pressure inlet and a high-pressure outlet. The fluid to be delivered preferably flows into the pump housing via the low-pressure inlet and out of the pump housing via the high-pressure outlet. The pump housing can be embodied in multiple parts, preferably two parts. The pump housing can for example comprise a housing cover and a housing cup. In this embodiment, the low-pressure inlet and/or the high-pressure outlet can be substantially delineated by the housing cup, i.e. the housing cover preferably delineates the low-pressure inlet and/or the high-pressure outlet at one end only or only partially or not at all.

A delivery rotor is arranged within the pump housing. The delivery rotor can be rotated about a rotational axis. Multiple delivery means are distributed over the circumference of the delivery rotor. The delivery means are preferably distributed at equal intervals over the circumference of the delivery rotor. Alternatively, or additionally, the delivery means can also exhibit varying distances from each other in the circumferential direction. The delivery means are designed to deliver the fluid to be delivered from the low-pressure inlet to the high-pressure outlet. If the rotary pump is for example a vane pump, the delivery means can be formed by moving vanes. The moving vanes can be arranged in a rotor base body of the delivery rotor such that they can be shifted or in principle also pivoted instead. Shifting vanes can be extended and retracted in relation to the rotational axis with a radial direction component. If the rotary pump is for example a gear pump, the delivery means can be formed by the teeth of a delivery gear.

The delivery rotor is preferably arranged axially between two end faces of the pump housing. If the pump housing is embodied in multiple parts, in particular two parts, the housing cover can comprise a first end face and the housing cup can comprise a second end face. The delivery rotor is for example arranged axially between the first end face and the second end face. In this embodiment, the delivery rotor can be delineated axially at one end by the housing cover. The housing cup can delineate the delivery rotor axially at one end and surround it. In other words, the delivery rotor can be delineated axially at one end and radially by the housing cup. This advantageously means that the delivery rotor can be inserted into the housing cup while the rotary pump is being manufactured, and the rotary pump can be simply sealed by attaching the housing cover. It is thus possible to ensure that the rotary pump can be manufactured cost-effectively.

When the delivery rotor rotates, in particular while the rotary pump is in operation, the radial and axial outer edges of the delivery means define a delivery region of the rotary pump. In other words, the delivery region can be defined by the integral of the delivery surface of a delivery means over one revolution of the delivery rotor, wherein the delivery surface is the surface of a delivery means which is in contact with the fluid to be delivered and/or delivers the fluid in the circumferential direction. If the rotary pump is for example a vane pump with moving vanes in a rotor base body, the delivery region is defined axially by the axial extent of the vanes. The delivery region preferably extends radially from the outer surface area of the rotor base body up to a circumferential surface which delineates the radial movement of the vanes outwards (away from the rotational axis), wherein this can in particular be an inner surface area of the pump housing or an inner surface area of a setting element. The latter is preferably the case if the vane pump exhibits an adjustable delivery volume.

The low-pressure inlet of the rotary pump can extend from a fluid port on the outer side of the pump housing up to the delivery region. The low-pressure inlet is preferably delineated by the pump housing. In relation to the rotational axis of the delivery rotor, the low-pressure inlet extends for example radially and/or tangentially into the pump housing. This has the advantageous effect that the rotary pump can be configured to be very compact and can in particular exhibit small axial dimensions. The fluid flowing through the low-pressure inlet can exhibit a main flow direction which is substantially orthogonal to the rotational axis of the delivery rotor. The term "substantially" is understood here to mean a deviation of ≤±20°. The low-pressure inlet preferably does not extend in the axial direction.

The rotary pump in accordance with an aspect of the invention comprises a flow channeling structure arranged in the low-pressure inlet. The flow channeling structure is designed to influence the fluid flowing in the low-pressure inlet. Preferably, only some of the fluid flowing in the low-pressure inlet is directly influenced by the flow channeling structure. The term "influence" is in particular understood to mean a change in direction, an acceleration and/or a deceleration of the fluid. The flow channeling structure is provided in the low-pressure inlet in such a way that it protrudes axially into the low-pressure inlet in relation to the rotational axis of the delivery rotor. For example, the flow channeling structure protrudes axially into the low-pressure inlet from a wall of the pump housing, which can delineate the low-pressure inlet.

The flow channeling structure can be embodied in one part and/or piece with the pump housing and in particular original-molded in one piece with the pump housing. If the pump housing consists of multiple parts, in particular two parts, the flow channeling structure can be embodied in one part and/or piece with the housing cup and in particular original-molded in one piece with the housing cup. Alternatively, the flow channeling structure can be a component of the rotary pump which is fastened in the housing, in particular fastened to the housing cup. The flow channeling structure is preferably provided completely within the housing cup. In other words, the flow channeling structure does not protrude either axially or radially out of the housing cup or beyond its outer dimensions. In another example embodiment, both the low-pressure inlet and the flow channeling structure are provided in the housing cup. In this embodiment, the rotary pump can be manufactured cost-effectively and/or has small dimensions, in particular small axial dimensions.

The flow channeling structure is arranged axially next to the delivery region. The flow channeling structure preferably extends completely axially next to the delivery region. In the radial direction, the flow channeling structure overlaps at least in portions with the delivery region. This has the technical advantage that the fluid flowing in the low-pressure inlet can also be influenced by the flow channeling structure even axially next to the delivery region.

In one example embodiment, there can be a first portion of the flow channeling structure in the radial direction, which radially overlaps with the delivery region. The flow channeling structure can also comprise a second portion which does not radially overlap with the delivery region but is rather preferably provided next to the delivery region in the radial direction. The second portion is preferably also embodied axially next to the delivery region, although in alternative embodiments, it can also axially overlap with the delivery region. It is for example conceivable for the second portion of the flow channeling structure to extend through the entire low-pressure inlet in the axial direction and for example divide it. Irrespective of this, the second portion of the flow channeling structure which does not radially overlap with the delivery region can extend axially over less than 75%, preferably less than 50%, of the axial extent of the delivery region, in particular the low-pressure region. Advantageously, the second portion directly adjoins the first portion in the radial direction, in particular radially outwards from the radially inner side.

The flow channeling structure preferably tapers counter to the flow direction of the fluid. In other words, a circumferentially measured width of the flow channeling structure can increase in the flow direction. Advantageously, the fluid to be delivered flows onto the flow channeling structure from a radial and/or tangential direction in relation to the rotational axis of the delivery rotor. Irrespective of this, the fluid to be delivered does not flow onto the flow channeling structure from an axial direction. It is thus advantageously possible to ensure a low overall height of the rotary pump.

The flow channeling structure can comprise an incident flow edge. The term "incident flow edge" is understood to mean an edge of the flow channeling structure which faces the fluid flowing onto the flow channeling structure. The incident flow edge is preferably the first structure of the flow channeling structure to come into contact with the fluid flowing onto the flow channeling structure. The stagnation point of the flow channeling structure is advantageously situated on the outer circumference of the incident flow edge. The incident flow edge can be spaced apart from the delivery region in the radial direction. The incident flow edge extends axially next to the delivery region and/or protrudes into an axial overlap with the delivery region. Irrespective of this, the incident flow edge can be arranged to be substantially parallel to the rotational axis of the delivery rotor. The term "substantially" is understood here to mean a deviation of ≤±10°.

Preferably, the flow channeling structure is respectively delineated in the circumferential direction by a side wall. The side walls can extend parallel to each other in the axial direction. Both side walls can for example extend substantially parallel to the rotational axis of the delivery rotor in the axial direction. The term "substantially" is understood here to mean a deviation of ≤±10°. Alternatively, the side walls can converge and/or diverge in the axial direction, in particular converge and/or diverge in portions. The side walls preferably extend linearly in the axial direction. Alternatively, or additionally, the side walls can each comprise concave and/or convex portions in the axial direction. The side walls can extend in the radial direction from the incident flow edge up to and into a radial overlap with the delivery region. The side walls preferably extend radially up to the end faces or up to an end face of the pump housing. The side walls can for example extend radially up to the end face of the housing cup.

A circumferentially measured distance between the side walls can increase in the flow direction of the fluid. The two side walls preferably exhibit a circumferentially measured maximum distance in the radial overlap with the delivery region. Irrespective of this, the circumferentially measured maximum distance between the two side walls can be smaller than a circumferentially measured maximum distance between two outer delivery means of a total of three adjacent delivery means. Alternatively, or additionally, the circumferentially measured maximum distance between the two side walls can be greater than a circumferentially measured maximum distance between two adjacent delivery means.

A first side wall of the flow channeling structure is preferably designed to redirect the fluid flowing along the first side wall. The fluid flowing along the first side wall is preferably directed in a direction counter to the rotational direction of the delivery rotor. In an example embodiment, the first side wall of the flow channeling structure can form a first inlet sub-channel together with a wall of the pump housing, in particular a wall of the pump housing which delineates the low-pressure inlet. The first inlet sub-channel is in particular open axially at one end, i.e. fluid communication is possible between the fluid flowing in the first inlet sub-channel and the fluid flowing in the rest of the low-pressure inlet. A sub-flow of the fluid to be delivered which flows in the first inlet sub-channel is influenced by the first inlet sub-channel. The direction and/or velocity of the sub-flow flowing through the first inlet sub-channel can in particular be influenced by the first inlet sub-channel. The sub-flow flowing through the first inlet sub-channel is for example directed in a direction counter to the rotational direction of the delivery rotor. Alternatively, or additionally, the first inlet sub-channel can exhibit a cross-section which tapers in the flow direction. This can advantageously accelerate the sub-flow flowing through the first inlet sub-channel.

A second side wall of the flow channeling structure is preferably designed to redirect the fluid flowing along the second side wall. The fluid flowing along the second side wall is preferably directed in a direction corresponding to the rotational direction of the delivery rotor. In an example embodiment, the second side wall of the flow channeling structure can form a second inlet sub-channel together with a wall of the pump housing, in particular a wall of the pump housing which delineates the low-pressure inlet. The second inlet sub-channel is in particular open axially at one end, i.e. fluid communication is possible between the fluid flowing in the second inlet sub-channel and the fluid flowing in the rest of the low-pressure inlet. A sub-flow of the fluid to be delivered which flows in the second inlet sub-channel is influenced by the second inlet sub-channel. The direction and/or velocity of the sub-flow flowing through the second inlet sub-channel can in particular be influenced by the second inlet sub-channel. The sub-flow flowing through the second inlet sub-channel is for example directed in a direction corresponding to the rotational direction of the delivery rotor. Alternatively, or additionally, the second inlet sub-channel can exhibit a cross-section which tapers in the flow direction. This can advantageously accelerate the sub-flow flowing through the second inlet sub-channel.

The flow channeling structure can be delineated axially by an axial end wall. The axial end wall can extend, at least in portions, orthogonally with respect to the rotational axis of the delivery rotor. Alternatively, or additionally, the axial end wall can exhibit, at least in portions, a convex and/or concave shape. Irrespective of this, an axially measured distance between the delivery region and the axial end wall can vary, in particular in the radial direction. The axial distance between the delivery region and the axial end wall can for example be at its smallest and in particular at a minimum in the first portion of the flow channeling structure. The axially measured distance between the delivery region and the axial end wall can be at its greatest and in particular at a maximum in the second portion. The axial end wall preferably exhibits a concave shape in the second portion.

A mean line of the flow channeling structure (or flow channeling structure center line) can exhibit a curvature in the radial direction. The term "mean line" which is common in fluid mechanics is understood in the present case to mean a line which connects all the center points of the circles which are inscribed by a profile of the flow channeling structure. The profile of the flow channeling structure is preferably defined by the outer edges of the flow channeling structure in a sectional view orthogonal to the rotational axis. The mean line is preferably curved in relation to the rotational axis of the delivery rotor radially outwards from the radially inner side towards the fluid port of the low-pressure inlet. This advantageously means that a fluid having a main flow direction which is radial and/or tangential to the rotational axis can be deflected by the flow channeling structure in such a way that the delivery region is optimally supplied and/or filled. Irrespective of this, a curved mean line has the positive technical effect that the design of the rotary pump can be chosen in a particularly variable and in particular compact way.

The first side wall can in particular be concave, preferably rounded and/or bulged inwards, in an axial plan view in order to channel the fluid in a direction counter to the rotational direction of the delivery rotor. The first side wall preferably faces the fluid flowing towards the flow channeling structure. The second side wall can in particular be convex, preferably rounded and/or bulged outwards, in the axial plan view in order to channel the fluid such that it is channeled to the delivery region in the rotational direction of the delivery rotor. The flow channeling structure can in particular have the shape of a shark fin, which tapers counter to the flowing fluid, in an axial plan view.

The rotary pump can in particular be designed for use in a motor vehicle. The rotary pump can accordingly be embodied as a motor vehicle pump. The rotary pump is preferably designed for delivering a liquid, in particular a lubricant and/or coolant and/or actuating medium. The rotary pump can accordingly be embodied as a liquid pump. The rotary pump is preferably designed for supplying and/or lubricating and/or cooling a drive motor and/or a transmission of a motor vehicle. The liquid is preferably an oil, for example an engine lubricating oil or a transmission oil. The rotary pump can in particular be embodied as an engine lubricant pump for a motor vehicle and/or as a transmission pump for a motor vehicle.

BRIEF DESCRIPTION OF THE DRAWINGS

The features described above can be combined with each other as desired, wherever technically expedient and suitable. Other features, combinations of features and advantages of aspects of the invention follow from the following description of example embodiments on the basis of the figures. There is shown.

DETAILED DESCRIPTION OF THE INVENTION

Figure 1:
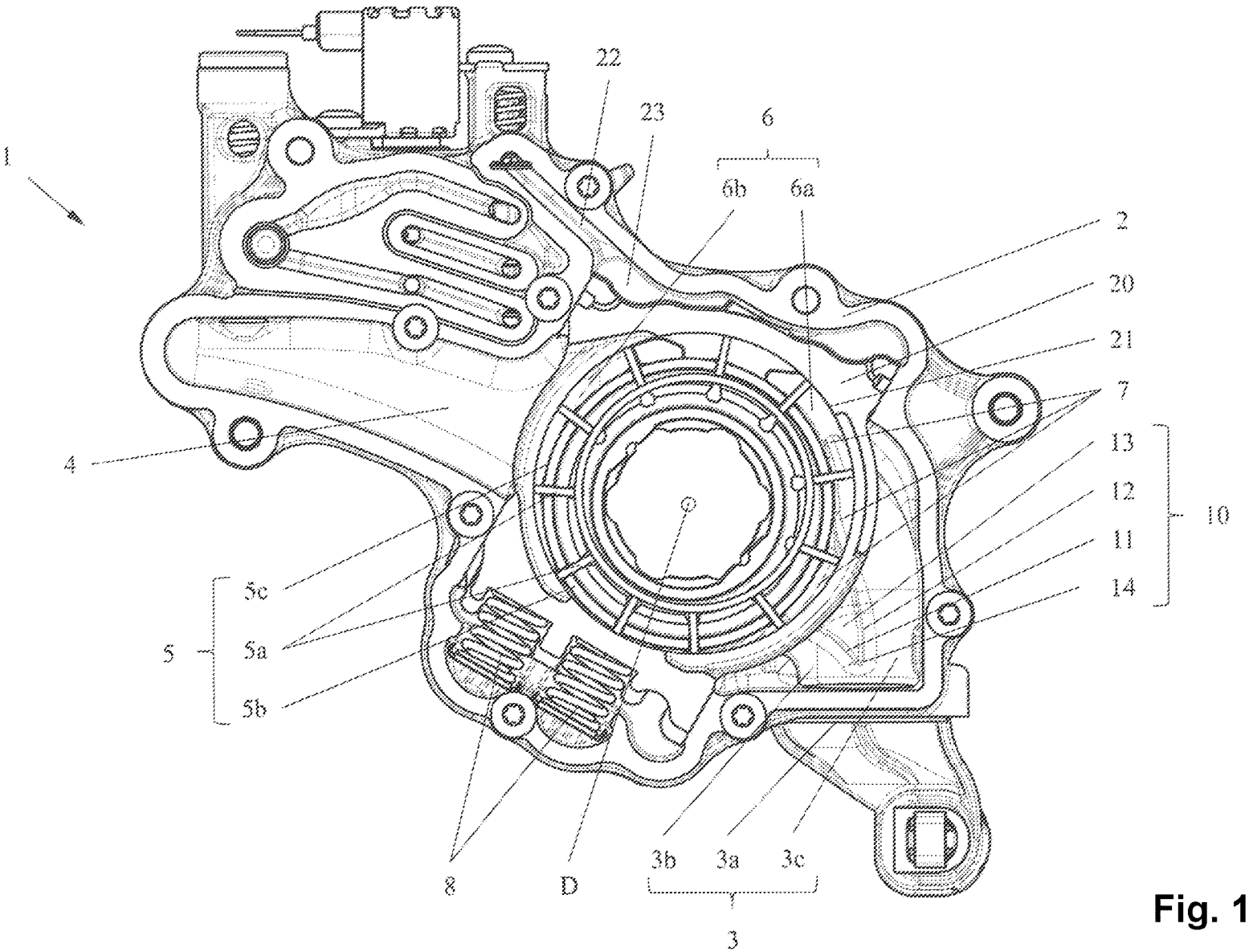
FIG. 1 a first sectional representation of an example embodiment of a rotary pump in accordance with the invention.

FIG. 1 is a sectional representation of an example embodiment of the rotary pump 1 in accordance with the invention. In the example embodiment, the rotary pump 1 is embodied as a vane pump. The rotary pump 1 comprises a pump housing 2 which comprises a low-pressure inlet 3 and a high-pressure outlet 4 for the fluid to be delivered. In order to channel the fluid to be delivered into the interior of the rotary pump 1, the low-pressure inlet 3 comprises a fluid port 3*a* on the outer wall of the pump housing 2. The fluid port 3*a* forms an inlet intersection for the low-pressure inlet 3, wherein the low-pressure inlet 3 extends into the pump housing 2. Similarly, the high-pressure outlet 4 comprises a fluid port (not shown) in order to channel the delivered fluid out of the rotary pump 1.

A delivery rotor 5 which can be rotated about a rotational axis D is provided within the pump housing 2. The delivery rotor 5 is arranged axially between two end faces of the pump housing 2. The delivery rotor 5 comprises a rotor base body 5*b* and multiple delivery means 5*a*. The delivery means 5*a* are distributed over the circumference of the rotor base body 5*b*. In the example embodiment shown, the delivery means 5*a* can be moved radially in relation to the rotational axis D and are arranged at equal distances from each other. The radial movement of the delivery means 5*a* is delineated radially inwards (towards the rotational axis D) by the rotor base body 5*b*. The radial movement of the delivery means 5*a* in the opposite direction, i.e. radially outwards (away from the rotational axis D), is delineated by an inner surface area 21 of a setting element 20.

In an alternative example embodiment (not shown), and in particular when the rotary pump 1 is embodied as an internal gear pump, the delivery rotor 5 could also for example be a gear, the teeth of which form the delivery means 5*a*.

While the rotary pump 1 is in operation, the delivery rotor 5 rotates about the rotational axis D, wherein the delivery means 5*a* are pressed radially outwards towards the inner surface area 21 of the setting element 20 due to the centrifugal force acting on the delivery means 5*a*. Together with the outer surface area 5*c* of the rotor base body 5*b* and the inner surface area 21 of the setting element 20, the axial outer edges of the delivery means 5*a* define a delivery region 6. The delivery region 6 is therefore an annular volume, the axial width of which corresponds to the width of the delivery means 5*a*. Each two adjacent delivery means 5*a* form a delivery cell 7 within the delivery region 6. The fluid to be delivered is supplied to the delivery region 6 or delivery cells 7 via the low-pressure inlet 3. In the delivery region 6, the fluid to be delivered is delivered from the low-pressure inlet 3 to the high-pressure outlet 4, wherein the fluid to be delivered is in particular delivered from the low-pressure inlet 3 to the high-pressure outlet 4 within the delivery cells 7 due to the direct influence of the rotating delivery means 5*a*.

The setting element 20 is designed to alter and/or adjust the delivery volume of the rotary pump 1. For this purpose, the setting element 20 can be moved back and forth between at least two positions in relation to the pump housing 2. In the example embodiment, the setting element 20 can be translationally moved, i.e. the setting element 20 is arranged such that it can be shifted in the pump housing 2. The inner surface area 21 of the setting element 20 extends around a central axis (not shown) which is offset in parallel in relation to the rotational axis D of the delivery rotor 5 when the setting element 20 is in a first position. Because the central axis of the setting element 20 is offset in parallel in relation to the rotational axis D of the delivery rotor 5, the setting element 20 exhibits an eccentricity in relation to the delivery rotor 5. FIG. 1 shows the setting element 20 in its first position.

In the first position, the delivery region 6 comprises a low-pressure region 6*a* in which the volume of the delivery cells 7 increases in the rotational direction of the delivery rotor 5. When the setting element 20 is in its first position, the delivery region 6 also comprises a high-pressure region 6*b* which adjoins the low-pressure region 6*a* in the rotational direction of the delivery rotor 5. In the high-pressure region 6*b*, the volume of the delivery cells 7 decreases in the rotational direction of the delivery rotor 5. The rotary pump 1 exhibits a maximum delivery volume in the first position.

In a second position (not shown), the setting element 20 is shifted in the pump housing 2 such that the setting element 20 exhibits a minimum eccentricity or no eccentricity in relation to the delivery rotor 5. In other words, the central axis of the setting element 20 is substantially or almost coaxial with the rotational axis D of the delivery rotor 5 in the second position. The rotary pump 1 exhibits a minimum delivery volume in the second position.

The first position and second position are preferably end positions of the setting element 20, i.e. the setting element 20 cannot assume a position in which it exhibits a greater eccentricity in relation to the delivery rotor 5 than in the first position and/or a smaller eccentricity in relation to the delivery rotor 5 than in the second position. The setting element 20 can assume multiple intermediate positions, for example any number of intermediate positions, between the first position and the second position.

The rotary pump 1 comprises a restoring means 8 in order to move the setting element 20 into the first position. The restoring means 8 preferably exerts a restoring force on the setting element 20, wherein the restoring force presses the setting element 20 into the first position. The restoring means 8 can comprise at least one restoring spring 8 which is supported on the one hand on the pump housing 2 and on the other hand on the setting element 20. In the example embodiment, the restoring means 8 comprises two restoring springs 8 which are supported on the one hand on the pump housing 2 and on the other hand on the setting element 20. In order to move the setting element 20 into the second position, the rotary pump 1 comprises a pressure channel 22 and a pressure chamber 23. The pressure chamber 23 extends between the pump housing 2 and the setting element 20. A pressurized fluid can be channeled into the pressure chamber 23 via the pressure channel 22. The fluid pressure prevailing in the pressure chamber 23 acts on the setting element 20, towards the second position, against the restoring force of the restoring means 8. The pressurized fluid can for example be the fluid to be delivered, which is preferably taken from the high-pressure outlet 4 and/or from the high-pressure region 6*b*.

The rotary pump 1 also comprises a flow channeling structure 10 which is arranged in the low-pressure inlet 3. The flow channeling structure 10 protrudes axially in relation to the rotational axis D from a wall of the pump housing 2 into the low-pressure inlet 3 (cf. for example FIGS. 2 and 4 to 6). The pump housing 2 and the flow channeling structure 10 are preferably embodied in one part and in particular original-molded with each other. The flow channeling structure 10 has a shape which tapers counter to the flow direction of the fluid to be delivered. A circumferentially measured width of the flow channeling structure 10 increases in the flow direction of the fluid to be delivered.

The flow channeling structure 10 is arranged in the low-pressure inlet 3 such that the flow channeling structure 10 extends axially next to the delivery region 6, in particular axially next to the low-pressure region 6*a*. The flow channeling structure 10 overlaps at least partially with the delivery region 6 in the radial direction. In alternative example embodiments which are not shown in the figures, a portion of the flow channeling structure 10 which does not radially overlap with the delivery region 6 could extend in the axial direction through the entire low-pressure inlet 3 and for example divide it. Irrespective of this, it is also conceivable for the portion of the flow channeling structure 10 which does not radially overlap with the delivery region 6 to extend axially over less than 75%, preferably less than 50%, of the axial extent of the delivery region 6, in particular the low-pressure region 6*a*.

The fluid flowing in the low-pressure inlet 3 flows onto the flow channeling structure 10 from a radial and/or tangential direction in relation to the rotational axis D. Preferably, it does not flow onto the flow channeling structure 10 from an axial direction. The flow channeling structure 10 is designed to influence, in particular redirect, the fluid flow flowing in the low-pressure inlet 3 or at least some of the fluid flow flowing in the low-pressure inlet 3, i.e. a first sub-flow of the fluid flow is for example redirected and/or deflected by the flow channeling structure 10 in such a way that the first sub-flow is provided with at least a flow direction component which is opposite to the rotational direction of the delivery rotor 5. A second sub-flow of the fluid flow is redirected and/or deflected by the flow channeling structure 10 in such a way that the second sub-flow is provided with at least a flow direction component which corresponds to the rotational direction of the delivery rotor 5.

The flow channeling structure 10 comprises an incident flow edge 14. The incident flow edge 14 forms a sort of leading edge or front edge of the profile of the flow channeling structure 10. In other words, the incident flow edge 14 is an edge which faces the fluid flowing in the low-pressure inlet 3 and which the fluid hits first when it flows in the low-pressure inlet 3 towards the flow channeling structure 10. The stagnation point of the flow channeling structure 10 is preferably situated on the outer circumference of the incident flow edge 14. Irrespective of this, the incident flow edge 14 is spaced apart from the delivery region 6, in particular the low-pressure region 6*a*, in the radial direction. The fluid flowing in the low-pressure inlet 3 flows onto the incident flow edge 14 from a radial and/or tangential direction in relation to the rotational axis D. Preferably, it does not flow onto the incident flow edge 14 from an axial direction.

The flow channeling structure 10 comprises a first side wall 11. The first side wall 11 protrudes axially into the low-pressure inlet 3. The first side wall 11 advantageously extends from the incident flow edge 14 into a radial overlap with the delivery region 6. The first side wall 11 exhibits a minimum distance from the rotational axis D which substantially corresponds to the radius of the outer surface area 5*c* of the rotor base body 5*b*. The fluid which flows along the first side wall 11 is redirected by the first side wall 11. The fluid flowing past the first side wall 11 is in particular directed in a direction counter to the rotational direction of the delivery rotor 5.

An opposite wall of the pump housing 2 facing the first side wall 11 forms a first inlet sub-channel 3*b* together with the first side wall 11. The first inlet sub-channel 3*b* is a channel in the low-pressure inlet 3 which is open axially at one end. A sub-flow of the fluid flowing in the low-pressure inlet 3 which flows in the first inlet sub-channel 3*b* is directed in a direction counter to the rotational direction of the delivery rotor 5 in the first inlet sub-channel 3*b*.

The flow channeling structure 10 comprises a second side wall 12. The second side wall 12 protrudes axially into the low-pressure inlet 3. The second side wall 12 advantageously extends from the incident flow edge 14 into a radial overlap with the delivery region 6. The second side wall 12 exhibits a minimum distance from the rotational axis D which substantially corresponds to the radius of the outer surface area 5*c* of the rotor base body 5*b*. The fluid which flows along the second side wall 12 is redirected by the second side wall 12. The fluid flowing past the second side wall 12 is in particular directed in a direction counter to the rotational direction of the delivery rotor 5.

An opposite wall of the pump housing 2 facing the second side wall 12 forms a second inlet sub-channel 3*c* together with the second side wall 12. The second inlet sub-channel 3*c* is a channel in the low-pressure inlet 3 which is open axially at one end. A sub-flow of the fluid flowing in the low-pressure inlet 3 which flows in the second inlet sub-channel 3*c* is directed in a direction corresponding to the rotational direction of the delivery rotor 5 in the second inlet sub-channel 3*c*.

The flow channeling structure 10 comprises an axial end wall 13. The axial end wall 13, the detailed shape of which is described more precisely below on the basis of FIGS. 4 to 6, connects the first side wall 11 to the second side wall 12 in the circumferential direction. The axial end wall 13 advantageously extends from the incident flow edge 14 into a radial overlap with the delivery region 6.

Figure 2:
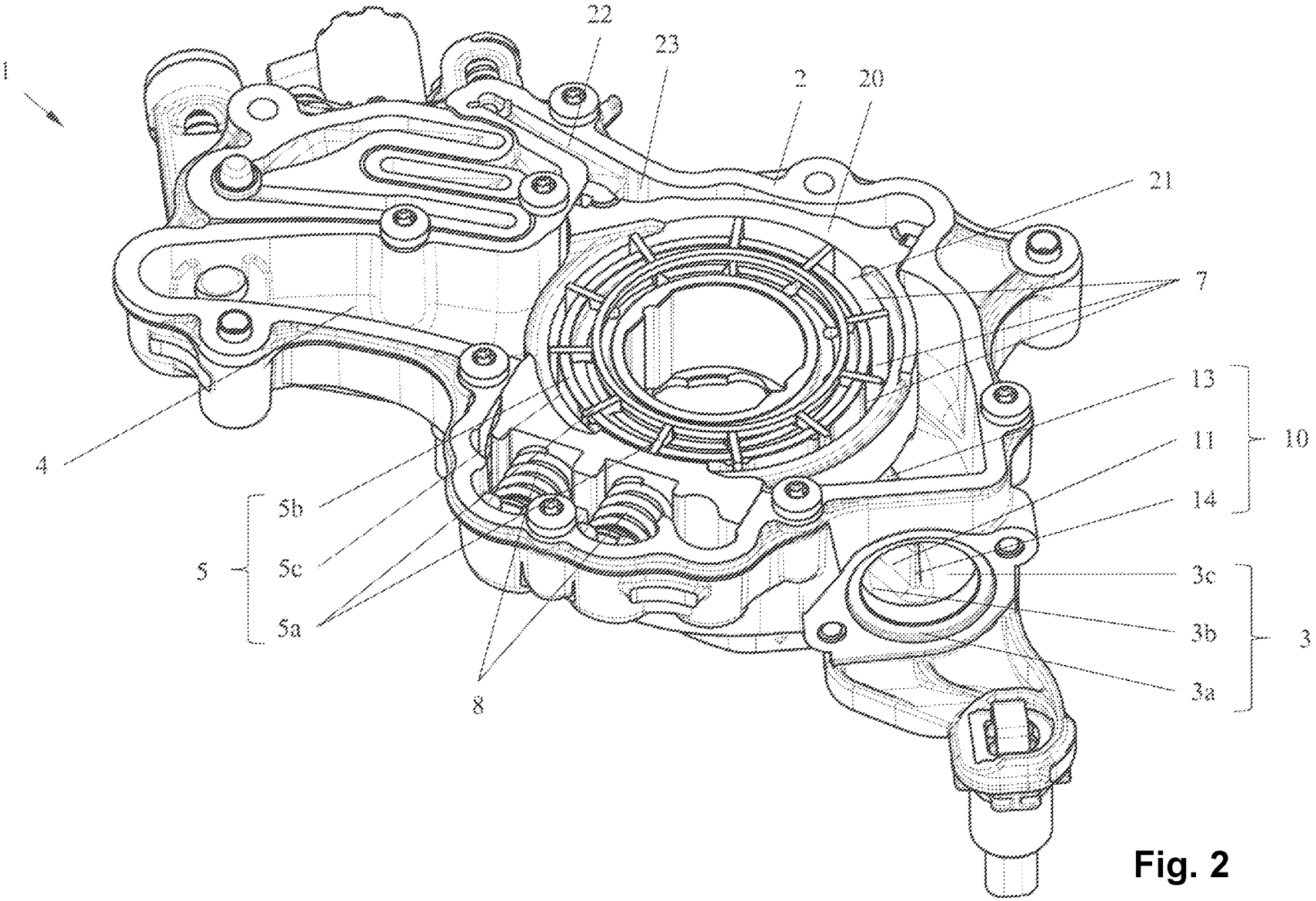
FIG. 2 a perspective representation of the sectional representation shown in FIG. 1.

For better comprehension, the sectional representation of the rotary pump 1 shown in FIG. 1 is shown in a perspective representation in FIG. 2. For an explanation of the structure and functionality of the rotary pump 1 depicted in FIG. 2, reference is made to the statements above.

Figure 3:
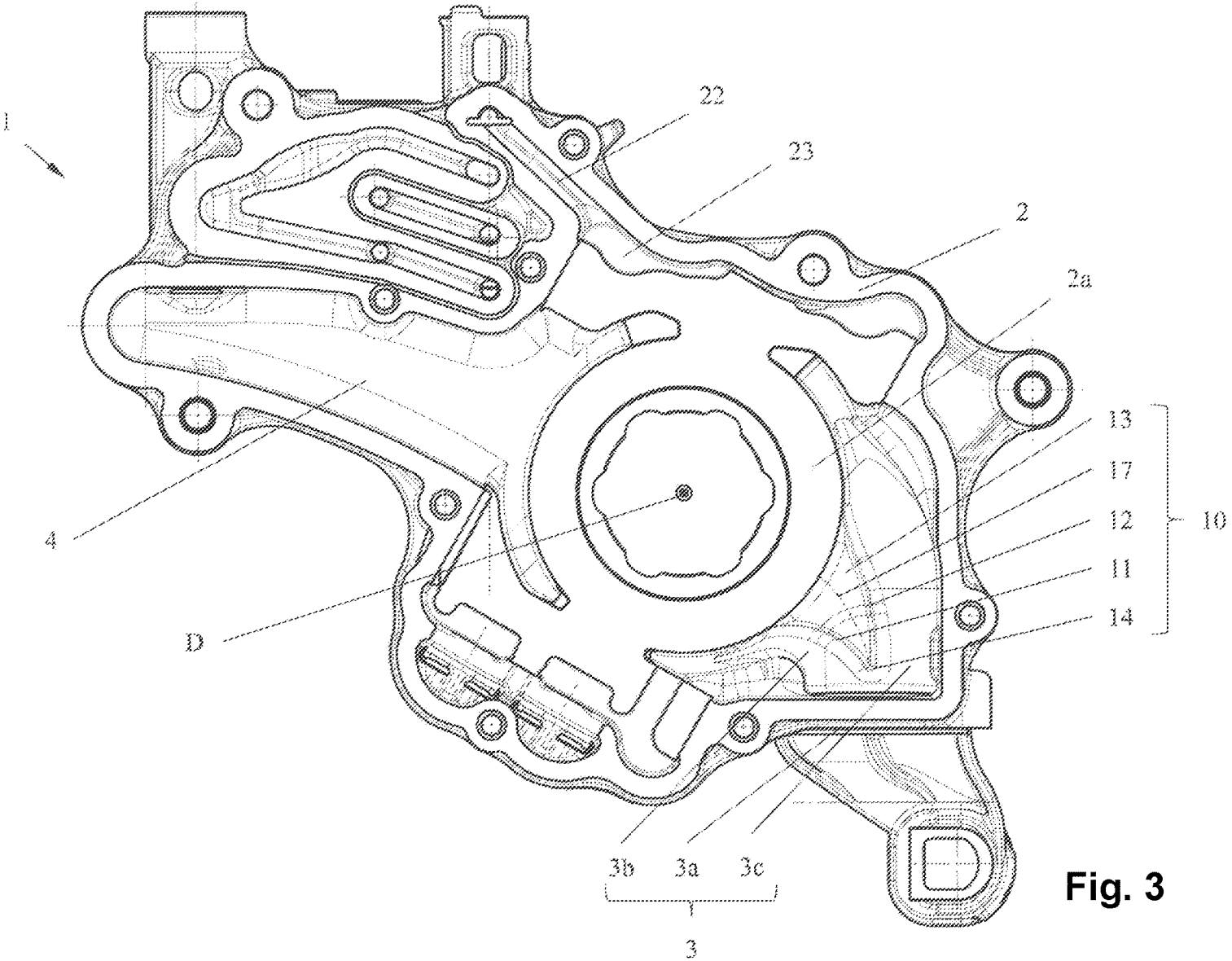
FIG. 3 a second sectional representation of the example embodiment shown in FIG. 1.

FIG. 3 shows a second sectional representation of the example embodiment shown in FIG. 1. The perspective of the second sectional representation shown in FIG. 3 corresponds to the perspective in FIG. 1. Unlike FIG. 1, FIG. 3 omits the setting element 20, the delivery rotor 5 and the restoring means 8.

The representation chosen in FIG. 3 reveals an end face 2*a* of the pump housing 2. The outer circumference of the end face 2*a* exhibits the same radius in relation to the rotational axis D as the outer surface area 5*c* of the rotor base body 5*b* (not shown in FIG. 3). In alternative example embodiments in which the rotary pump 1 is for example embodied as an internal gear pump 1, the outer circumference of the end face 2*a* can exhibit the same radius in relation to the rotational axis D as the root circle radius of the internal gear.

In the example embodiment shown in FIG. 3, the first and second side walls 11, 12 extend in the radial direction up to the outer circumference of the end face 2*a*. A circumferentially measured distance between the first side wall 11 and the second side wall 12 increases towards the outer circumference of the end face 2*a*.

A mean line 17 of the flow channeling structure 10 (also called the flow channeling structure center line 17) has been added to FIG. 3. The mean line 17 extends in the flow direction from the incident flow edge 14 up to the outer circumference of the end face 2*a*. Irrespective of this, the mean line 17 exhibits a curvature in the radial direction. The mean line 17 is in particular curved radially outwards from the radially inner side towards the fluid port 3*a* of the low-pressure inlet 3.

As shown in the example embodiment, the first inlet sub-channel 3*b* tapers in the flow direction. In other words, the cross-section of the first inlet sub-channel 3*b* decreases in the flow direction. The first inlet sub-channel 3*b* is embodied in the shape of a nozzle, such that the flow velocity of the fluid flowing in the first inlet sub-channel 3*b* increases along the first inlet sub-channel 3*b*. Irrespective of this, the second inlet sub-channel 3*c* tapers in the flow direction. In other words, the cross-section of the second inlet sub-channel 3*c* decreases in the flow direction. The second inlet sub-channel 3*c* is embodied in the shape of a nozzle, such that the flow velocity of the fluid flowing in the second inlet sub-channel 3*c* increases along the second inlet sub-channel 3*c*.

In an axial view, the flow channeling structure 10 has the shape of a shark fin which is bulged concavely inwards in the profile of the first side wall 11 facing the inflowing fluid and bulged convexly outwards in the profile of the second side wall 12, in order to channel the fluid towards the delivery region 6 in a way which is favorable in terms of flow dynamics.

Figure 4:
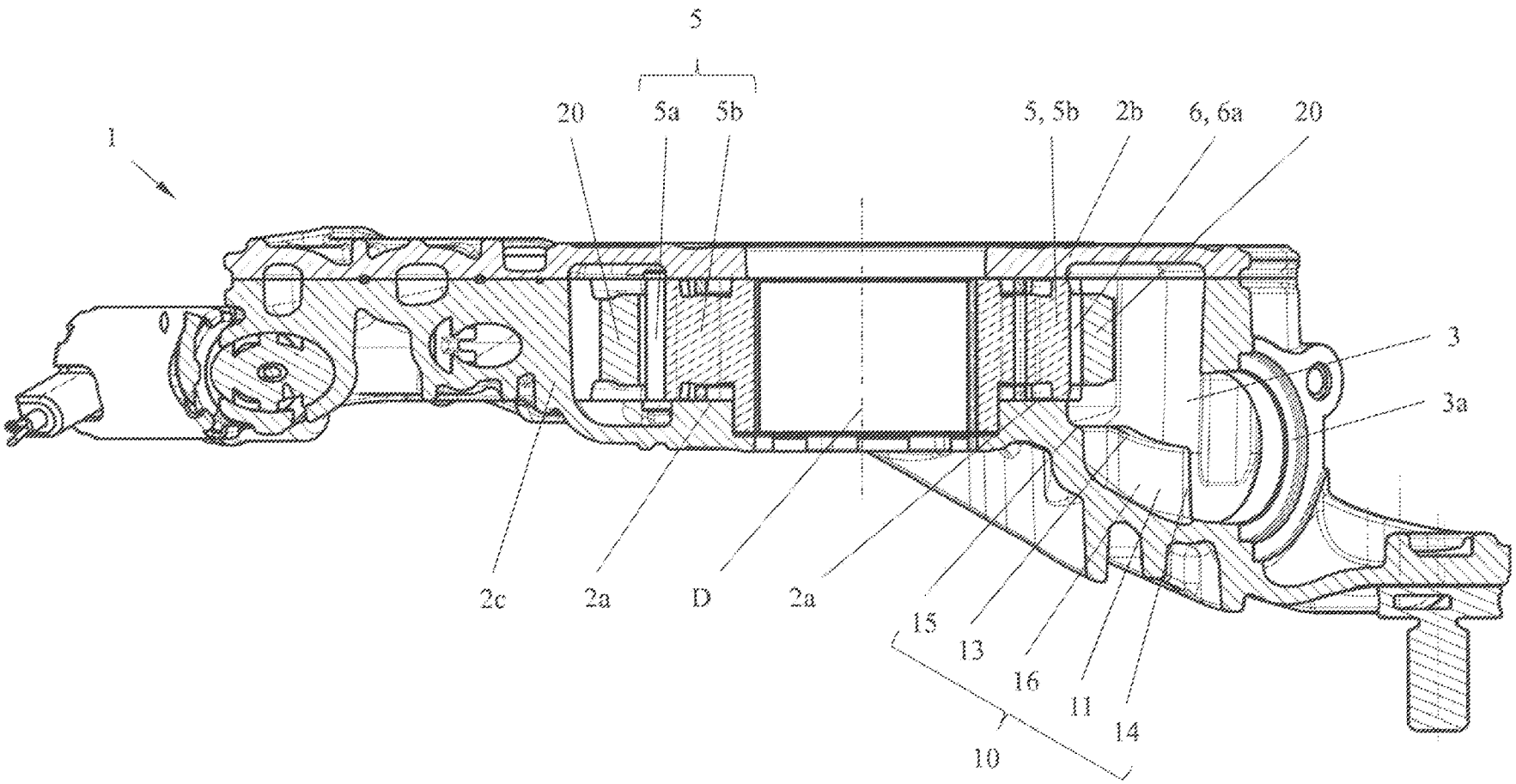
FIG. 4 a third sectional representation of the example embodiment shown in FIG. 1.
Figure 5:
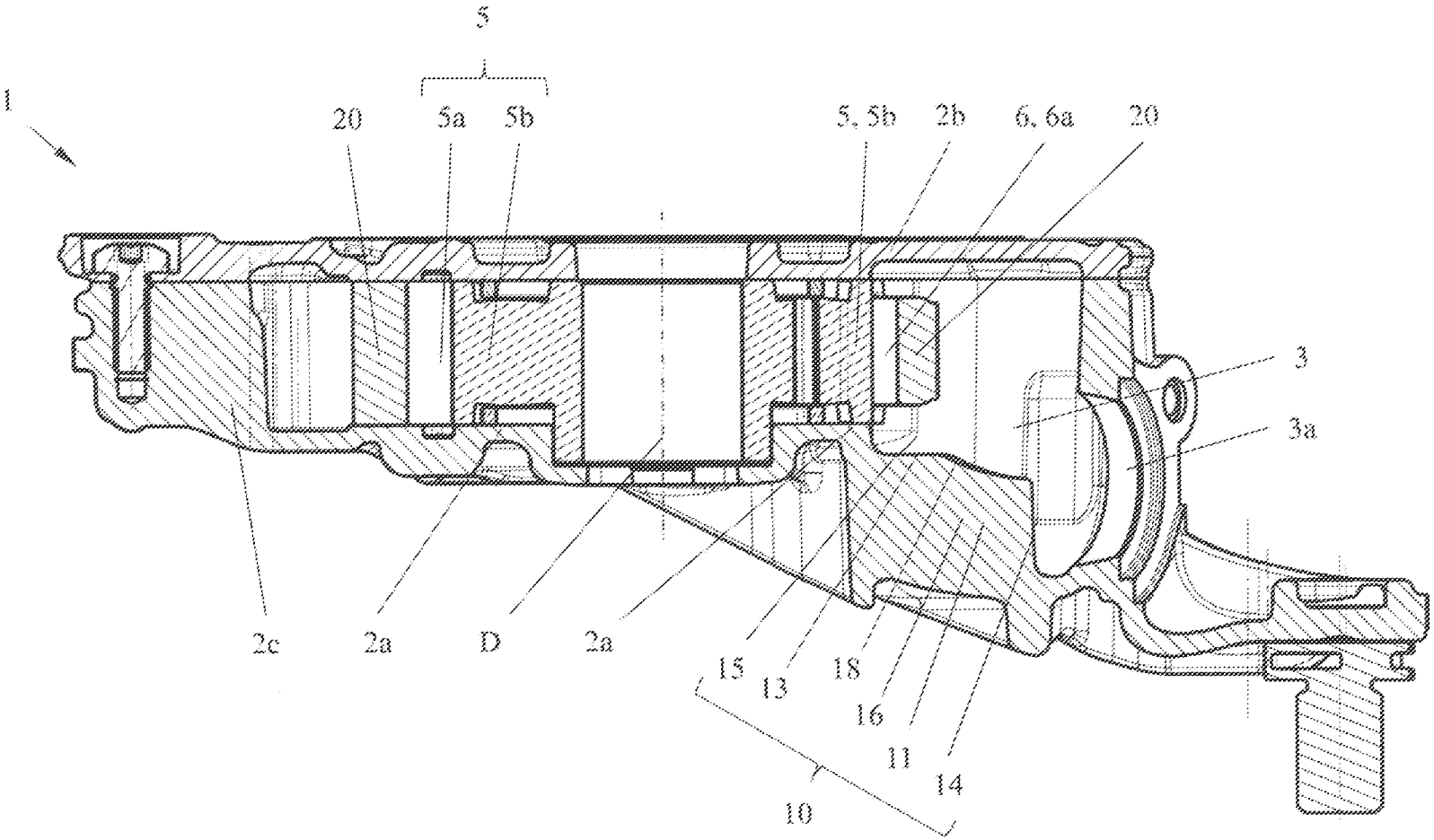
FIG. 5 a fourth sectional representation of the example embodiment shown in FIG. 1.

FIGS. 4 and 5 show a third and fourth sectional view of the example embodiment of the rotary pump 1 shown in FIG. 1. The third and fourth sectional views have been taken along the rotational axis D of the rotary pump 1. Unlike the third sectional view in FIG. 4, the sectional plane of the fourth sectional view (FIG. 5) has been rotated in the rotational direction of the delivery rotor 5 by a few degrees about the rotational axis D.

In the example embodiment of the rotary pump 1 shown, the pump housing 2 is embodied in two parts. The pump housing 2 comprises a housing cover 2*b* and a housing cup 2*c*. The housing cover 2*b* comprises a first end face 2*a*, and the housing cup 2*c* comprises a second end face 2*a* opposite the first end face 2*a*. The delivery rotor 5 is arranged axially between the two end faces 2*a*. The housing cup 2*c* comprises the fluid port 3*a* of the low-pressure inlet 3. The flow channeling structure 10 is also embodied completely within the housing cup 2*c*. The second end face 2*a* of the housing cup 2*c* defines an imaginary plane (not shown in the figures) which extends orthogonally with respect to the rotational axis D.

As shown in FIGS. 4 and 5, the flow channeling structure 10 comprises a first portion 15 which radially overlaps with the delivery region 6, in particular the low-pressure region 6*a*. The axial end wall 13 exhibits an orthogonal distance from the imaginary plane, wherein said distance is at least partially constant in the first portion. Irrespective of this, the axial end wall 13 transitions into the second end face 2*a* in the first portion 15, in particular in the region of the outer circumference of the second end face 2*a*.

The flow channeling structure 10 comprises a second portion 16. The second portion 16 adjoins the first portion 15 in the radial direction, radially outwards in relation to the rotational axis D. In other words, the second portion 16 is arranged directly next to the first portion 15 counter to the flow direction. The second portion 16 does not radially overlap with the delivery region 6. Irrespective of this, the second portion 16 comprises the incident flow edge 14. The orthogonal distance between the axial end wall 13 and the imaginary plane varies in the second portion 16. In the region of the incident flow edge 14, the axial end wall 13 exhibits a maximum orthogonal distance from the imaginary plane. The orthogonal distance between the axial end wall 13 and the imaginary plane decreases in the flow direction and/or radially inwards from the radially outer side. In the second portion 16, the axial end wall 13 exhibits a concave surface shape in relation to the imaginary plane.

As can be seen in FIG. 5, the free upper side of the flow channeling structure 10, i.e. the end face 13, forms a ramp 18 which rises towards the setting element 20. The ramp 18 can in particular be formed in the region of the portion 16. Fluid flowing over the ramp 18 is provided with an axial direction component by the ramp 18, such that it also flows with an axial direction component in an elongation of the ramp 18 into the delivery cells 7 passing through the low-pressure region 6*a*.

Figure 6:
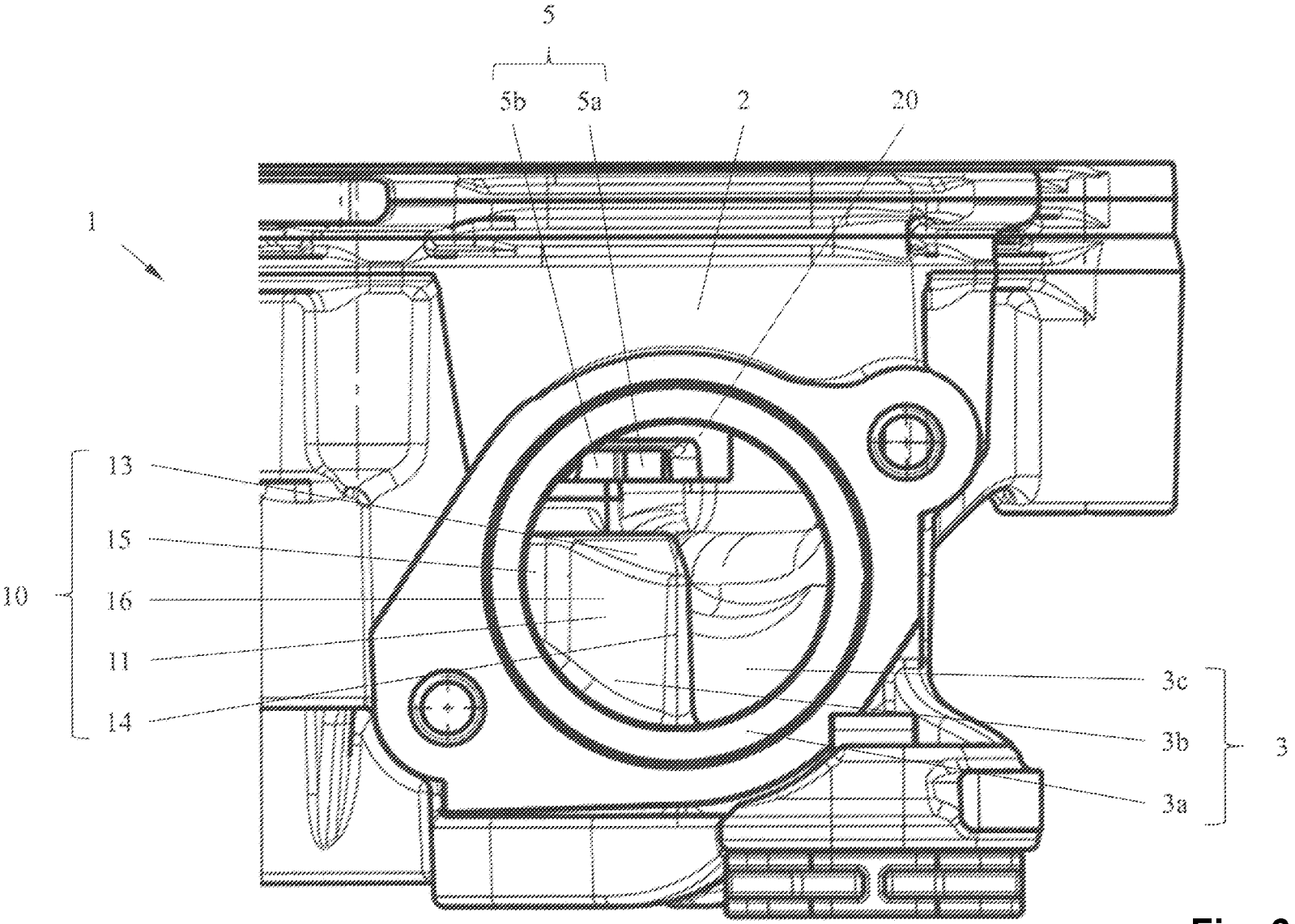
FIG. 6 a detail of a side view of the example embodiment shown in FIG. 1.

FIG. 6 shows a detail of a side view of the example embodiment of the rotary pump 1 shown in FIG. 1. FIG. 6 offers the observer a perspective view into the fluid port 3*a* of the low-pressure inlet 3, wherein the second portion 16 of the flow channeling structure 10 is particular easy to see. With regard to the specific configuration of the flow channeling structure 10, reference is made to the statements above.

| Reference signs: | |
|---|---|
| 1 | rotary pump |
| 2 | pump housing |
| 2a | end face |
| 2b | housing cover |
| 2c | housing cup |
| 3 | low-pressure inlet |
| 3a | fluid port |
| 3b | first inlet sub-channel |
| 3c | second inlet sub-channel |
| 4 | high-pressure outlet |
| 5 | delivery rotor |
| 5a | delivery means |
| 5b | rotor base body |
| 5c | outer surface area of the rotor base body |
| 6 | delivery region |
| 6a | low-pressure region |
| 6b | high-pressure region |
| 7 | delivery cells |
| 8 | restoring means |
| 9 | — |
| 10 | flow channeling structure |
| 11 | first side wall |
| 12 | second side wall |
| 13 | axial end wall |
| 14 | incident flow edge |
| 15 | first portion |
| 16 | second portion |
| 17 | mean line |
| 18 | ramp |
| 19 | — |
| 20 | setting element |
| 21 | inner surface area of the setting element |
| 22 | pressure channel |
| 23 | pressure chamber |
| D | rotational axis of the delivery rotor |

The invention claimed is:

1. A rotary pump for delivering a fluid, the rotary pump comprising:

(a) a pump housing having a low-pressure inlet and a high-pressure outlet for the fluid to be delivered; and (b) a delivery rotor arranged such that it is rotatable about a rotational axis in the pump housing and comprising (c) multiple delivery means which are distributed over the circumference of the delivery rotor for delivering the fluid from the low-pressure inlet to the high-pressure outlet, wherein (d) when the delivery rotor rotates, the radial and axial outer edges of the delivery means define a delivery region of the rotary pump, and (e) the rotary pump comprises a flow channeling structure which protrudes axially into the low-pressure inlet in relation to the rotational axis and is designed to influence the fluid flowing in the low-pressure inlet, wherein (f) the flow channeling structure is arranged along an axial region which does not overlap with an axial extent of the delivery region and is arranged along a radial region which overlaps with a radial extent of the delivery region, wherein (g) the flow channeling structure comprises an incident flow edge which is spaced apart from the delivery region in the radial direction and arranged substantially parallel to the rotational axis, such that the fluid flowing in the low-pressure inlet flows onto the incident flow edge from a radial and/or tangential direction in relation to the rotational axis.

2. The rotary pump according to claim 1, wherein the width of the flow channeling structure is delineated in the circumferential direction by two side walls, and the circumferentially measured width of the flow channeling structure increases in the flow direction of the fluid to be delivered.

3. The rotary pump according to claim 2, wherein a circumferentially measured maximum distance between the two side walls is greater than a circumferentially measured maximum distance between two adjacent delivery means, and/or the circumferentially measured maximum distance between the two side walls is smaller than a circumferentially measured maximum distance between the two outer delivery means of a total of three adjacent delivery means.

4. The rotary pump according to claim 2, wherein the side walls extend in the radial direction from the incident flow edge up to and into a radial overlap with the delivery region.

5. The rotary pump according to claim 1, wherein the side walls extend in the radial direction from the incident flow edge up to and into a radial overlap with the delivery region.

6. The rotary pump according to claim 1, wherein a first side wall of the flow channeling structure together with the wall of the low-pressure inlet forms a first inlet sub-channel which is open axially at one end, and the fluid flowing through the first inlet sub-channel is directed in a direction counter to the rotational direction of the delivery rotor.

7. The rotary pump according to claim 1, wherein a second side wall of the flow channeling structure together with the wall of the low-pressure inlet forms a second inlet sub-channel which is open axially at one end, and the fluid flowing through the second inlet sub-channel is directed in a direction corresponding to the rotational direction of the delivery rotor.

8. The rotary pump according to claim 1, wherein a first side wall of the flow channeling structure together with the wall of the low-pressure inlet forms a first inlet sub-channel which is open axially at one end, and the fluid flowing through the first inlet sub-channel is directed in a direction counter to the rotational direction of the delivery rotor, wherein a second side wall of the flow channeling structure together with the wall of the low-pressure inlet forms a second inlet sub-channel which is open axially at one end, and the fluid flowing through the second inlet sub-channel is directed in a direction corresponding to the rotational direction of the delivery rotor, and wherein the first inlet sub-channel and/or the second inlet sub-channel exhibit(s) a cross-section which tapers in the flow direction.

9. The rotary pump according to claim 1, wherein the flow channeling structure is delineated axially by an axial end wall which is embodied, at least in portions, to be concave and/or convex.

10. The rotary pump according to claim 9, wherein the flow channeling structure comprises a first portion which overlaps with the delivery region in the radial direction, wherein the axial end wall exhibits a minimum axial distance from the delivery region in the first portion.

11. The rotary pump according to claim 9, wherein the flow channeling structure comprises a second portion which is provided radially next to the delivery region, wherein the axial end wall is embodied, at least in portions, to be concave and/or convex in the second portion.

12. The rotary pump according to claim 1, wherein a mean line of the flow channeling structure exhibits a curvature in the radial direction.

13. The rotary pump according to claim 1, wherein the flow channeling structure is arranged in the low-pressure inlet such that the fluid flowing in the low-pressure inlet flows onto the flow channeling structure from a radial and/or tangential direction in relation to the rotational axis.

14. The rotary pump according to claim 1, wherein the low-pressure inlet extends from a fluid port on the outer wall of the pump housing up to the delivery region.

15. The rotary pump according to claim 1, wherein the rotary pump is a vane pump or a gear pump.

16. The rotary pump according to claim 1, wherein the flow channeling structure is designed to redirect the fluid flowing in the low-pressure inlet.

17. The rotary pump according to claim 1, wherein the low-pressure inlet extends from a fluid port on the outer wall of the pump housing in a radial and/or tangential direction up to the delivery region.

* * * * *